US005642812A

United States Patent [19]

Hale

[11] Patent Number: 5,642,812

[45] Date of Patent: Jul. 1, 1997

[54] CABLE AND PARTS CONTAINER

[76] Inventor: Leon A. Hale, 217 Bayou View Dr., El Lago, Tex. 77586

[21] Appl. No.: 519,388

[22] Filed: Aug. 25, 1995

[51] Int. Cl.[6] ..... B65D 85/04; B65D 25/10

[52] U.S. Cl. ..... 206/396; 206/303; 206/397; 206/408; 229/120.15; 242/588.2

[58] Field of Search ..... 206/395, 396, 206/397, 389, 408, 410, 303; 242/588.2, 588.4, 588.6, 590; 229/120.15, 120.16, 120.22

[56] References Cited

U.S. PATENT DOCUMENTS

| | | | |
|---|---|---|---|
| 1,356,331 | 10/1920 | Allport | 206/395 |
| 1,798,333 | 3/1931 | Marlowe et al. | 229/120.22 X |
| 2,216,323 | 10/1940 | Ringler | 206/806 X |
| 2,860,773 | 11/1958 | Zackheim | 206/408 X |
| 3,150,769 | 9/1964 | Cohn | 242/588.2 X |
| 3,229,812 | 1/1966 | Metzger | 206/396 |
| 3,613,973 | 10/1971 | Jaeschke | 206/395 X |
| 3,982,712 | 9/1976 | Bassett | 206/395 X |
| 4,140,218 | 2/1979 | Forté | 206/395 X |
| 4,160,533 | 7/1979 | Kotzor et al. | 206/397 X |
| 4,168,778 | 9/1979 | Buxton | 206/397 X |
| 4,511,037 | 4/1985 | Lucous | 206/396 |
| 4,714,191 | 12/1987 | Richardson | 206/395 X |
| 4,817,796 | 4/1989 | Camillo et al. | 206/396 |
| 5,064,066 | 11/1991 | Barnes | 206/395 |
| 5,150,789 | 9/1992 | Bass | 206/396 |

*Primary Examiner*—Bryon P. Gehman

[57] ABSTRACT

A right regular container for mounting a cable reel also includes a flexible integral tongue portion for retaining, securing and protecting small parts and subassemblies to be used when installing a hardwired network such as typically used with computers.

10 Claims, 4 Drawing Sheets

CABLE AND PARTS CONTAINER

BACKGROUND

The present invention pertains to hollow containers; more particularly, the present invention pertains to hollow containers designed for use with cable reels.

In recent years, there has been a rapid growth in the number of computers being used in homes and businesses. In order to share both software and data, many computer users network their computers together. Such networks include hardwire connections between individual computer workstations and one or more network server computers and data storage devices. Hardwire networks are normally invisible to the individual computer user but for the wires which run between the back of an individual computer workstation and a small plastic panel mounted on a wall. However, to network a group of computers together with one or more network server computers and data storage devices requires numerous small parts and connection subassemblies between the wall-mounted plastic panel and the wires which run within the walls to other individual computer workstations and two or more network server computers and data storage devices.

Installers of computer networks typically prepare for their work by tallying the number of individual work stations, network server computers and data storage devices to be connected together. The installers then calculate the amount of wire needed and the number of part sets required to make the necessary connections to all the computers and data storage devices in the network. Because of ever changing conditions, miscalculations are often made. Such miscalculations may result in an undersupply of parts. When this occurs, the installation of the computer network is delayed, and the cost to the network installer increases because of the time and money needed to make up for the shortage of necessary parts at the job site. However, if all parts required to connect an individual computer workstations, computer network server computers and data storage devices together in a network were located together, it would then be possible for network installers to merely grab a single box of parts together with the required length of wire for each individual computer or data storage device to be wired into a computer network. Thus, the network installer would be assured that all necessary parts to complete the installation of the computer network are available when needed.

There is, therefore, a need in the art to provide a system by which all necessary parts for installing computer networks are provided to network installers in a single, easy-to-use package.

SUMMARY

The cable and parts container of the present invention provides a system whereby all necessary parts for installing computer networks are provided to network installers in a single, easy-to-use package. Specifically, the disclosed cable and parts container provides a package in which all necessary cable, small parts and connection subassemblies for wiring a computer network are together in a single location. Within the cable and parts container of the present invention is an interior tongue portion which, by its flexible nature, can be used to secure, retain and protect small parts and connection subassemblies in the space surrounding the enclosed cable reel. The flexible interior tongue portion is formed as an integral portion of the bottom of the container.

By forming the flexible interior tongue portion as an integral portion of the bottom portion of the container, the cable and parts container of the present invention may be made from a single piece of cardboard.

Thus, if a computer network installer knows that it will be necessary to make, for example, a thirty-foot run of computer network cable, then a container containing thirty feet of cable is taken from stock. In addition to containing the required type and length of cable, the container will also contain all the required hardware to install the thirty-foot run of computer network cable between the computers or data storage devices in the computer network.

BRIEF DESCRIPTION OF THE DRAWINGS

A better understanding of the cable and parts container of the present invention may be had by reference to the figures wherein.

DESCRIPTION OF THE EMBODIMENTS

Figure 1:
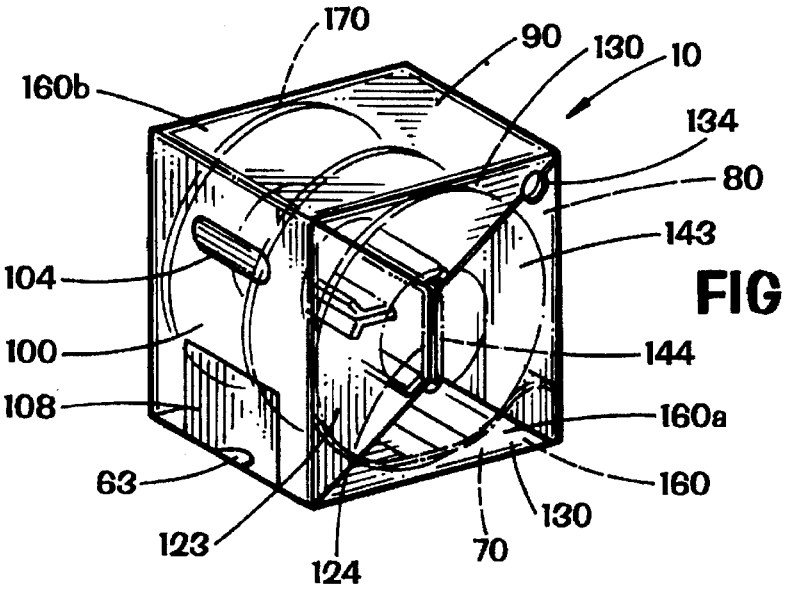
FIG. 1 is a perspective view of the assembled cable and parts container of the present invention with the interior shown in phantom.

The complete cardboard cable and parts container 10 of the present invention is shown assembled in FIG. 1. Shown in phantom within the container 10 is a cable reel 170 and the flexible interior tongue 60 for securing, retaining and protecting small parts and connection subassemblies. Some distinguishing external features include the hand-hold 104 and the access panel 108 on the front wall 100. On the right side of the container 10 is a first trapezoidal arm 123 and a second trapezoidal arm 143. At the narrow base of the trapezoidal arms 123 and 143, are two folds 124 and 144, respectively.

Figure 7:
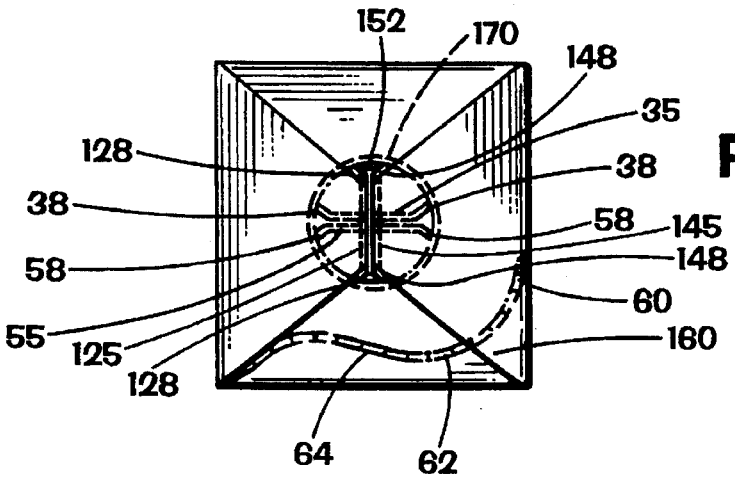
FIG. 7 is a cross-sectional view of the assembled cable and parts container at a plane just inside the right side wall.

Extending inwardly into the container 10 from the two folds 124 and 144 are two spindle portions which hold a cable reel 170, as shown in FIG. 7. The mounting of the cable reel 170 may be slightly off center. Locking the two spindle portions in position are two pairs of locking tabs 128 and 148 which extend upwardly and downwardly, respectively, from the insert portions 125 and 145. The insert portions 125 and 145 are attached to the trapezoidal arms 123 and 143 at the two folds 124 and 144, respectively. Assembly of the spindle portions will be described below with references to FIGS. 7A and 7B.

As may also be seen in FIGS. 1 and 7, the interior of the box includes a flexible interior tongue 60. The flexible interior tongue 60 includes a plurality of folds 62 which form individual panels 64. The use of these individual panels 64 which are formed by the folds 62 is to secure, retain and protect small parts and connection subassemblies used to make the required connections when computers and data storage devices are networked together. Such small parts or connection subassemblies are held in space 160. If desired, the position of flexible tongue 60 with respect to the base 70 can be at a right angle to accommodate such parts as a wall plate or wall box eliminator.

Figure 2:
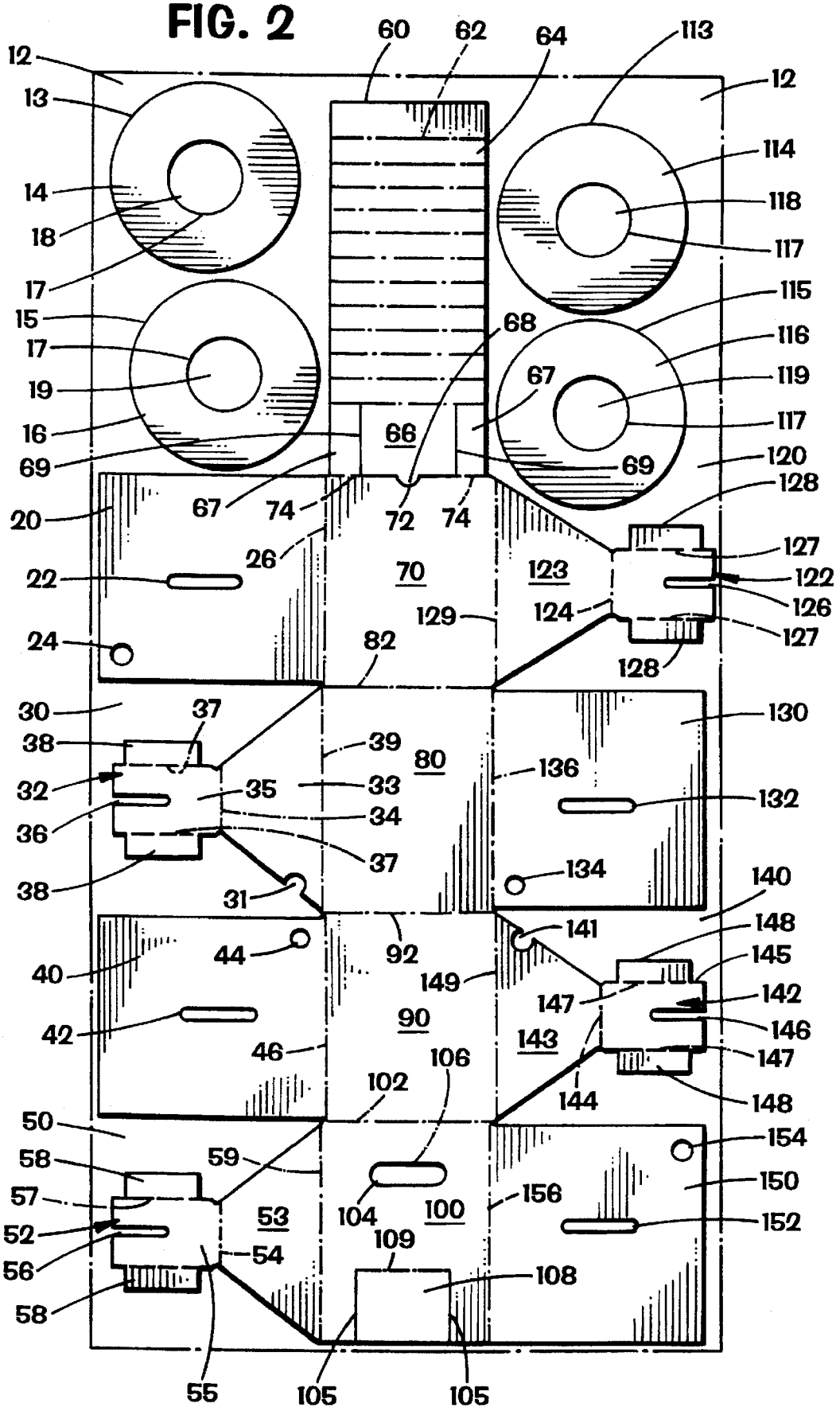
FIG. 2 is a plan view of the cardboard blank from which the cable and parts container is formed.

The container 10 of the present invention is formed from a single piece of cardboard. The layout of cuts and folds on the single piece of cardboard 11 is shown in FIG. 2. The following description of the cuts and folds in the single piece of cardboard 11 begins in the upper left-hand corner and then proceeds vertically to the bottom along the left-hand side. The second portion of the description begins with the center portion and proceeds downwardly. The description of the right-hand side goes from top to bottom just like with the other two sections.

Beginning in the upper left-hand corner of the cardboard blank 11 is the first accessory panel 12. Shown in the first accessory panel 12 are two cable reel flanges 14 and 16. The cable reel flanges 14 and 16 are punched from the first accessory panel 12 at cut lines 13 and 15, respectively. Disks 18 and 19 are punched out of the cable reel flanges 14 and 16 along cut lines 17 to enable the cable reel flanges 14 to fit on the ends or middle portion of the central tube 170 of a cable reel, if desired. While flanges 14 and 16 are shown in the preferred embodiment, it will be understood by those of ordinary skill in the art that a variety of shapes may be formed out of the first accessory panel 12.

Underneath the first accessory panel 12 is the left-hand inner side wall panel 20. The left-hand inner side wall panel 20 is substantially rectangular and includes a central slot 22. Formed in the lower left-hand corner of left-hand inner side wall panel 20 is a large hole 24 whose use will be described below. Along the right side of left-hand inner side wall panel 20 is a fold line 26.

Underneath the left-hand inner side wall panel 20 is the panel 30 from which the left-hand upper spindle portion assembly 32 is formed. The left-hand upper spindle portion assembly 32 features a trapezoidal arm 33 which has fold line 39 on its long base and fold line 34 at its short base. Formed in the bottom side of the trapezoidal arm 33 is hole segment 31 which will eventually line up with the hole 24 in the left-hand inner side wall panel 20.

On the other side of the fold line 34 from the trapezoidal arm 33 is the insert portion 35. The insert portion 35 has two locking tabs 38, one on either side and corresponding fold lines 37 which are formed where the two locking tabs 38 extend from the insert portion 35. At the outboard end of the insert portion 35 is a slot 36. The slot 36 facilitates insertion of the spindle portions through the side walls of the assembled container 10.

Underneath the left-hand upper spindle portion assembly 32 is the outer side wall panel 40. Similar to the left-hand inner side wall panel 20 described above, the outer side wall panel 40 features a central slot 42, a small hole 44 and a fold line 46 along its interior side.

Underneath the outer side wall panel 40 is the left-hand lower spindle panel 50. Similar to the left-hand upper spindle portion assembly 32 is the left-hand lower spindle assembly 52. The left-hand lower spindle assembly 52 also features a trapezoidal arm 53 which has on its long base a fold line 59 and another fold line 54 on its short base. Extending from the fold line 54 is an insert portion 55 which includes two locking tabs 58. The two locking tabs 58 terminate at two fold lines 57. Also included in the insert portion 55 is a slot 56 which facilitates the insertion of the spindle portions through the side walls of the container 10.

Moving to the central portion and back to the top of the cardboard blank 11, there is found the flexible interior tongue 60. The flexible interior tongue 60 attaints its flexibility by a plurality of substantially parallel fold lines 62 which form panels 64 therebetween. At the bottom of the flexible interior tongue 60 are two unfolded legs 67. These legs 67 have along their interior wall two cut lines 69. These two cut lines 69 form an access panel 66 therebetween. At the bottom of the access panel 66 is a semicircular tab 68. It is the flexible interior tongue 60 which will eventually be used to secure, retain and protect the small parts and connection subassemblies in the interior space 160 within the container 10.

If desired, numerous different shapes of cutouts and fold lines may be formed in flexible interior tongue 60. Specifically, holes of different shapes may be cut into the flexible interior tongue 60, or small tabs may be pushed out upwardly or downwardly from the flexible interior tongue 60 to act as further means to secure, retain and protect small parts and connection subassemblies in the space 160 within the container 10.

Formed just underneath the flexible interior tongue 60 in the cardboard blank 11 is a bottom wall 70. The bottom wall 70 is connected to the unfolded legs 67 by two fold lines 74. Formed underneath the semicircular tab 68 on the access panel 66 is a notch 72.

Formed underneath the bottom wall 70 is a rear wall 80. The rear wall 80 is connected to the bottom wall 70 by a fold line 82.

Formed underneath the rear wall 80 is a top wall 90. Connecting the top wall 90 to the rear wall 80 is a fold line 92.

Formed underneath the top wall 90 is a front wall 100. Connecting the front wall 100 to the top wall 90 is a fold line 102. The front wall 100 features a hand-hold cutout 104 which is partially severed from the front wall 100, but is attached thereto by a fold line 106. At the bottom of the front wall 100 is found an access door 108. The access door 108 is formed by two cut lines 105 on either side of the access door 108 and a fold line 109 formed along its top.

Formed on the right side of the cardboard blank 11 is a second accessory panel 112. While cable reel flanges 114 and 116 are shown as being formed in the second accessory panel 112, it will be understood by those of ordinary skill in the art that a variety of different shapes may be cut from the second accessory panel 112. Such shapes may be formed in the same way that flanges 114 and 116 are formed; that is, by forming one or more cut lines 113 and 115 to describe the outer perimeter of such shapes and one or more cut lines 117 to describe any punch-out portions of such shapes, such as disks 118 and 119.

Underneath the second accessory panel 112 is the right-hand rear spindle portion panel 120. As has previously been described with respect to the left-hand spindle portions, the right-hand rear spindle portion assembly 122 includes a trapezoidal arm 123 which is joined to the bottom wall 70 at fold line 129. The insert portion 125 is connected to the short base of the trapezoidal arm 123 at a fold line 124. Two locking tabs 128 are connected to the insert portion 125 at two fold lines 127. A slot 126 is formed in the end of the insert portion 125.

Underneath the spindle portion assembly 122 is found an outer side wall panel 130. Similar to the side wall panels 20 and 40 found on the left-hand side, the right-hand outer side wall panel 130 features a central slot 132 and a hole 134. The outer side wall panel is attached to the rear wall 80 at a fold line 136.

Underneath the outer side wall panel 130 is found the right-hand front spindle portion panel 140. The right-hand front spindle portion assembly 142 is formed similarly to the right-hand rear spindle portion assembly 122 in that it includes a trapezoidal arm 143 with a hole section 141 and an insert portion 145. The right-hand front spindle portion assembly 142 is connected to the top wall 90 by a fold line 149. Separating the trapezoidal arm 143 and the insert portion 145 is a fold line 144. Two locking tabs 148 are attached to the insert portion 145 by two fold lines 147. A slot 146 is included at the end of the insert portion 145.

Underneath the right-hand front spindle portion assembly 142 is the right-hand inner side wall panel 150. Like the right-hand outer side wall portion 130, the right-hand inner side wall portion 150 features a central slot 152 and a hole 154. Connecting the right-hand inner side wall panel 150 to the front wall 100 is a fold line 156.

The cable and parts container 10 of the present invention is then folded from the cardboard panel 11 according to the steps shown in FIGS. 3, 4, 5 6, 7A and 7B.

Figure 3:
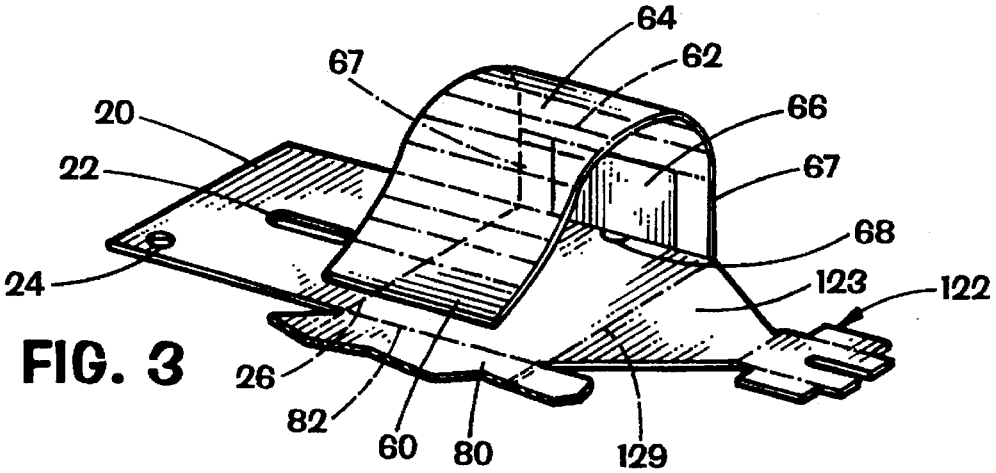
FIG. 3 is a diagram of the first step of forming the cable and parts container.

In FIG. 3, the flexible interior tongue 60 is folded along its various fold lines 62 so that it will fit within the interior of the assembled cable and parts container 10. The flexible interior tongue 60 is then folded upwardly along the fold lines 74 so that it is at right angles to the bottom wall 70.

Figure 4:
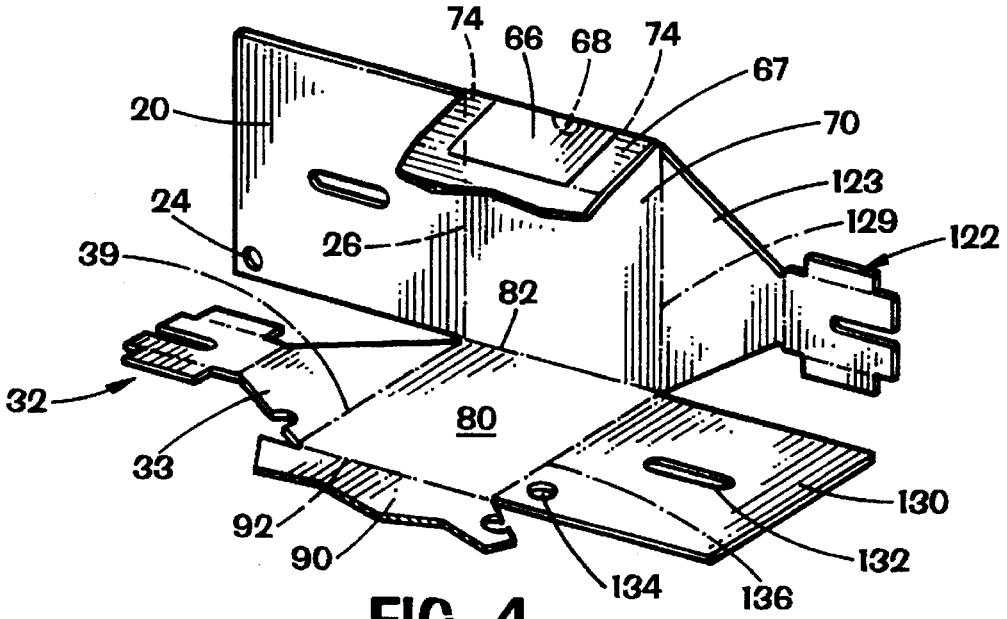
FIG. 4 is a diagram of the second step of forming the cable and parts container.

As shown in FIG. 4, the bottom wall 70 is to be at a right angle to the rear wall 80. This is accomplished by folding the cardboard along a fold line 82.

Figure 5:
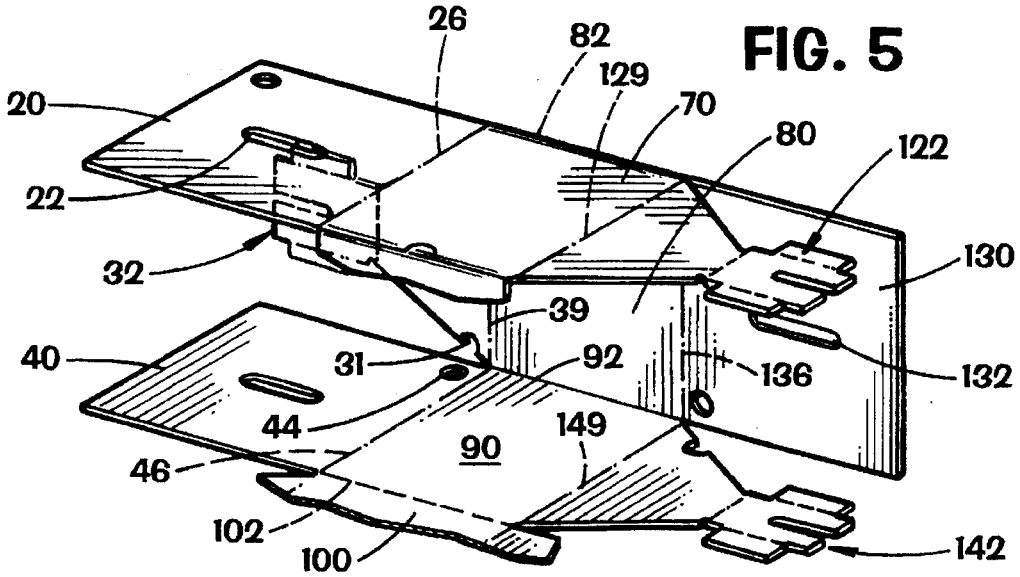
FIG. 5 is a diagram of the third step in forming the cable and parts container.

Continuing the roll-up of the flat cardboard panel 11, and as shown in FIG. 5, the rear wall 80 is then folded upwardly along a fold line 92 to be at a substantially right angle to the top wall 90. Following this step, the four side walls 20, 40, 150 and 130 are folded inward, as shown by arrows A and B. Then the four spindle portion assemblies 32, 52, 122 and 142 are folded inward, as shown by arrows C and D and FIGS. 7A and 7B.

Figure 6:
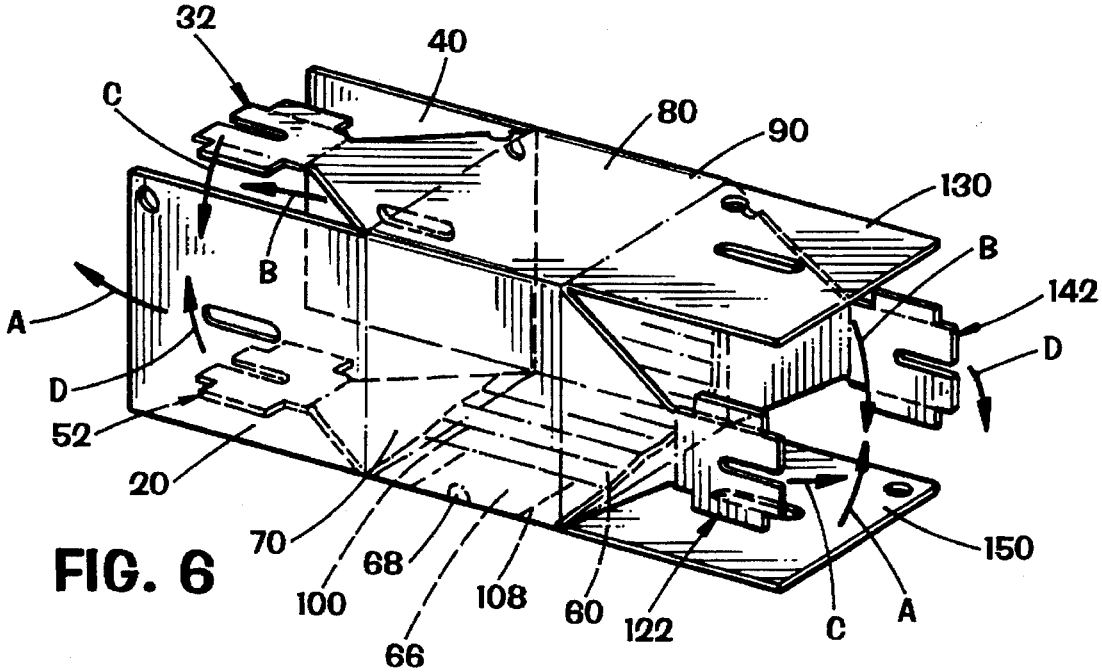
FIG. 6 is a diagram of the fourth step of forming the cable and parts container.

The fourth side of the container 10 is formed, as shown in FIG. 6, by moving the top wall 90 to a position at a substantially right angle to the front wall 100. If accomplished properly, the central portion of the cardboard panel 11 now forms a substantially rectangular tube including the bottom 70, the rear wall 80, the top 90, and the front wall 100. Extending inside the substantially rectangular tube is the flexible interior tongue 60.

Figure 7A:
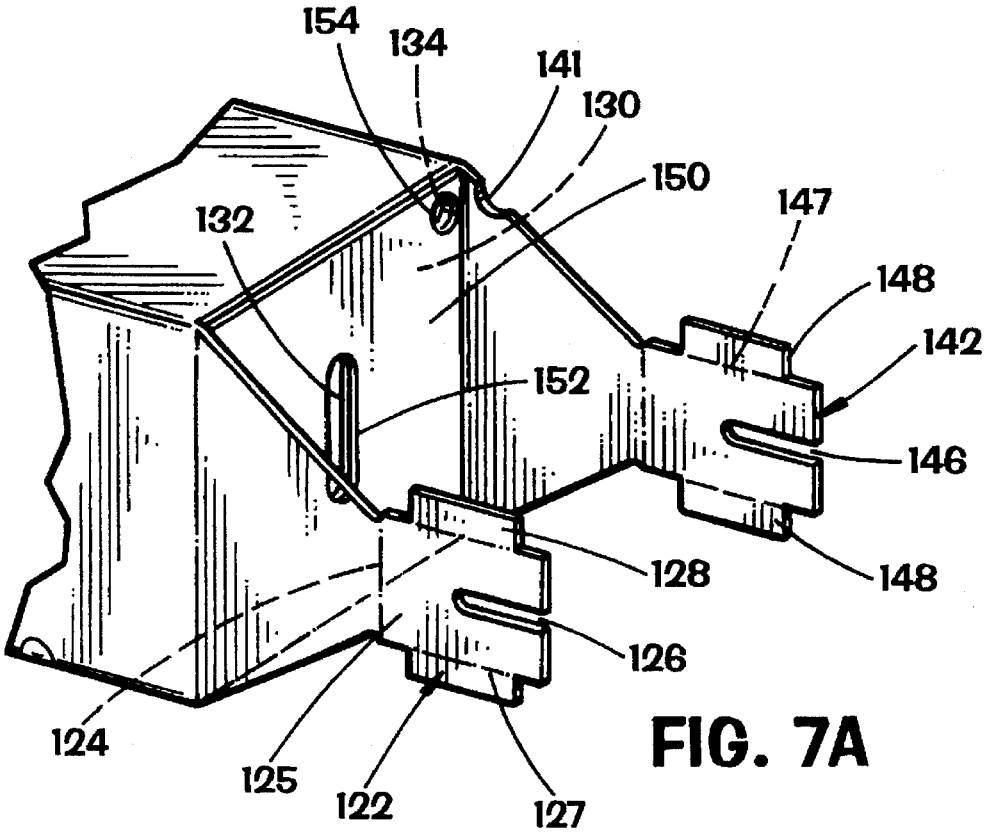
FIGS. 7A and 7B are perspective views of the cable and parts container which illustrate the assembly of the side walls and cable reel mountings.
Figure 7B:
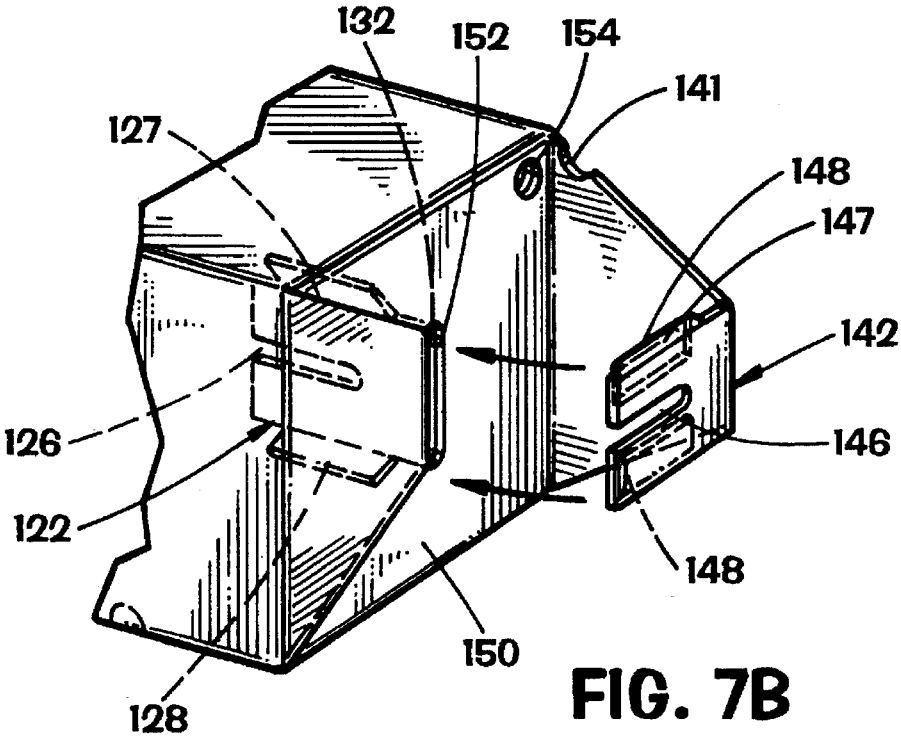

To form the cable reel mountings which extend into the interior 160 of the container 10, it is now necessary to fold the side panels and the spindle mounting portions into shapes which will allow their insertion into the interior 160 of the container 10. As shown in FIGS. 7A and 7B, this is accomplished by first folding in the right-hand inner side wall panel 150 along its fold line 156, and then overlapping the right-hand inner side wall panel 150 with the outer side wall panel 130 by folding along its fold line 136. This causes an alignment of the slots 132 and 152. The holes 134 and 154 will also be in alignment with hole segment 141.

In order to form the spindle mounting portions, it is then necessary to insert the insert portions 125 and 145 of the spindle mounting assemblies 122 and 142, respectively, through the single slot formed by slots 132 and 152. This is accomplished by bending the tabs 128 and 148 back along their fold lines 127 and 147, respectively. Secondly, the insert portions 125 and 145 are then folded along their fold lines 124 and 144, respectively. When the locking tabs 128 and 148 are folded back to be flush with the insert portions 125 and 145, they may be inserted individually through the slot formed by slots 132 and 152. The insert portions 125 and 145 will then protrude into the interior 160 of the assembled container 10. The resilience of the cardboard will cause the locking tabs 128 and 148 to spring away from the insert portions 125 and 145, respectively, and thus lock the insert portions 125 and 145 in position as shown in FIG. 7. The hole segment 141 of the right-hand front spindle portion assembly 142 will fall into alignment with the two holes designated 134 and 154.

The assembly of the opposite or left wall of the container 10 is accomplished as previously described with respect to the left wall.

As previously indicated, the holes designated as 24, 44, 134, and 154 will fall into alignment. If desired, a rod may be inserted through these four holes to enable the container 10 to be hung from a rod or bar.

To mount a cable reel 170 as shown in FIG. 7 on the inner spindle portions which extend through the side walls of the container 10, it will be necessary to place the cable reel 170 on one of the spindle portions before the other side of the container 10 is folded together. If desired, one or more of the flanges 14, 16, 114 and 116 may be placed on the cable reel 170 to separate various types of cable, should such be necessary. The flexible tongue 60 divides the space 160 within the container 10 into a first compartment **160*a* and a second compartment 160*b* (see FIG. 1). Small parts and connection subassemblies may then be loaded within the space 160 a of the first compartment formed under the flexible interior tongue 60 and with the cable reel 170 in the second compartment 160*b*. As will be understood by those of ordinary skill in the art, the container 10 is self-locking when a cable reel 170 is included. This is because the locking tabs 38, 58, 128 and 148 are not accessible, as they are within the cable reel 170**.

When it is desired to utilize cable or gain access to the interior 160 of box 10, access may be gained through the access door 108 and the access panel 66.

While the present invention has been made out of heavy-duty cardboard, it will be understood by those of ordinary skill in the art that a variety of other materials having properties similar to heavy-duty cardboard may be used without departing from the scope and utility of the present invention.

The foregoing invention has been described with respect to its preferred embodiment. It will be understood by those of ordinary skill in the art that other embodiments of the disclosed invention may be possible, once having understood its preferred embodiment. Such other embodiments of the invention shall fall within the scope and meaning of the appended claims.

I claim:

1. A box for containing parts and a cable reel with cable thereon, the box comprising a box member having interconnected sides folded to form the box, the box member further comprising a bottom, a top, a front wall, a back wall and a left-side wall and a right-side wall interconnecting with said bottom and said top, a first spindle portion protruding into the interior of the substantially try right regular hollow container through a first hole in said left-side wall, and a second spindle portion protruding into the interior of the substantially right regular hollow container through a second hole in said right-side wall, a flexible tongue connected to the box member and contained within the box upon folding of the interconnected sides forming the box, the flexible tongue dividing the box into a first compartment and a second compartment, the first compartment for holding the cable reel, the second compartment for holding the parts, and the second compartment comprising an enclosed space apart from the first compartment, the flexible tongue positioned for retaining the parts in the second compartment.

2. The box of claim 1 wherein the flexible tongue has a length and a plurality of fold lines along its entire length and a plurality of panels formed between the fold lines along its entire length.

3. The box of claim 2 wherein the flexible tongue is flexible along its entire length to assume a shape corresponding to a shape of the cable reel.

4. The box of claim 1 further comprising a movable access door formed in the box member providing access to parts in the second compartment.

5. The box of claim 1 further comprising hanger holes formed in and through the box member.

6. The box of claim 1 wherein the left side wall has a center and the first hole is off center in the left side wall and the right side wall has a center and the second hole is off center in the right side wall.

7. The box of claim 1 further comprising a movable access door formed in the box member providing access to a cable reel in the first compartment.

8. A box for containing parts and a cable reel with cable thereon, the box comprising a box member having interconnected sides folded to form the box, a flexible tongue connected to the box member and contained within the box upon folding of the interconnected sides forming the box, the flexible tongue dividing the box into a first compartment and a second compartment, the first compartment sized and configured to hold the cable reel, the second compartment for holding the parts, and the second compartment comprising an enclosed space apart from the first compartment, the flexible tongue positioned for retaining the parts in the second compartment, the flexible tongue having a length and a plurality of fold lines along its entire length and a plurality of panels formed between the fold lines along its entire length, the flexible tongue flexible along its entire length to assume a shape corresponding to a shape of the cable reel, a movable access door formed in the box member providing access to parts in the second compartment, hanger holes formed in and through the box member, the box member further comprising a bottom, a top, a front wall, a back wall and a left-side wall and a right-side wall interconnecting with said bottom and said top, a first spindle portion protruding into the interior of the substantially right regular hollow container through a first hole in said left-side wall, and a second spindle portion protruding into the interior of the substantially right regular hollow container through a second hole in said right-side wall, wherein the left side wall has a center and the first hole is off center in the left side wall and the right side wall has a center and the second hole is off center in the right side wall, and a movable access door formed in the box member providing access to a cable reel in the first compartment.

9. The box of claim 8 wherein said flexible tongue is formed integrally with said box member, said spindle portions are formed as an integral part of said box member, and further including a cable reel mounted on said spindle portions.

10. The box of claim 9 wherein said flexible tongue has a plurality of holes for securing said parts thereto and a plurality of punch and fold-out panels for securing said parts thereto.

* * * * *